United States Patent [19]

Van Klompenburg

[11] 4,083,264

[45] Apr. 11, 1978

[54] ROTATABLE KNOB ASSEMBLY

[75] Inventor: Marlo G. Van Klompenburg, Owatonna, Minn.

[73] Assignee: Truth Incorporated, Owatonna, Minn.

[21] Appl. No.: 739,600

[22] Filed: Nov. 8, 1976

[51] Int. Cl.[2] ..... G05G 1/00; B25G 1/00; E05B 1/00; E05B 7/00

[52] U.S. Cl. ..... 74/545; 74/553; 16/121; 16/DIG. 30; 292/347

[58] Field of Search ..... 74/545, 543, 553, 558.5; 16/118, 121, DIG. 24, DIG. 30; 292/347, 349, 356

[56] References Cited

U.S. PATENT DOCUMENTS

| | | | |
|---|---|---|---|
| 245,542 | 8/1881 | Moran | 16/118 |
| 1,388,922 | 8/1921 | Bullard | 16/DIG. 30 |
| 1,759,771 | 5/1930 | Willi | 16/118 |
| 2,290,815 | 7/1942 | Ruppel | 74/545 |
| 2,496,700 | 2/1950 | Cole | 74/543 |
| 3,229,322 | 1/1966 | Herr et al. | 16/121 |
| 3,306,643 | 2/1967 | Reed | 292/1 |

FOREIGN PATENT DOCUMENTS

| | | | |
|---|---|---|---|
| 825,433 | 3/1938 | France | 16/121 |
| 2,218,505 | 10/1973 | Germany | 74/545 |
| 2,264,511 | 1/1974 | Germany | 74/545 |

*Primary Examiner*—Samuel Scott
*Assistant Examiner*—Don E. Ferrell
*Attorney, Agent, or Firm*—Wegner, Stellman, McCord, Wiles & Wood

[57] ABSTRACT

A rotatable knob assembly having a knob easily mounted to the mounting section of an operating member, with the mounting section having two adjacent parts with a first part having a generally elliptical cross section and the other part having a generally circular cross section and with the knob having an open-ended cavity and an upstanding ridge on the inner surface of the cavity surrounding the wall which is of generally the same perimetrical length as the generally equal perimetrical lengths of the two parts of the mounting section. The knob is formed of a material which is capable of being distorted whereby placement of the knob on the mounting section by relative insertion of the mounting section into the cavity causes distortion of the locking ring to pass over the generally elliptical cross section part and the locking ring then returns to its normal shape to engage against the generally circular part of the mounting section and to lock behind the elliptical section.

8 Claims, 5 Drawing Figures

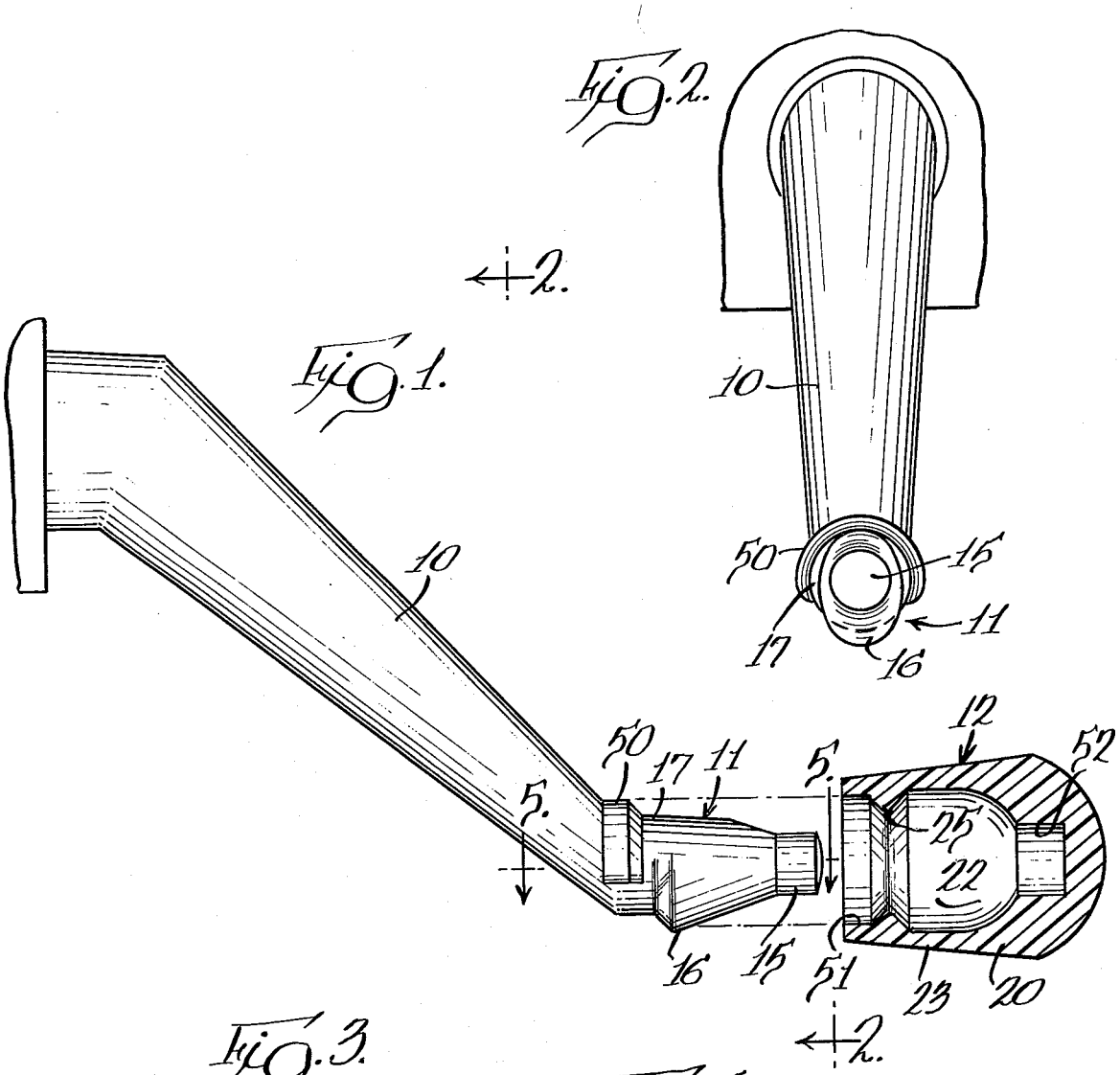
Fig. 2.
10
50
15
11
17
16
2.
Fig. 1.
10
50
17
11
5.
5.
12
52
25
22
16
15
51
23
20
2.
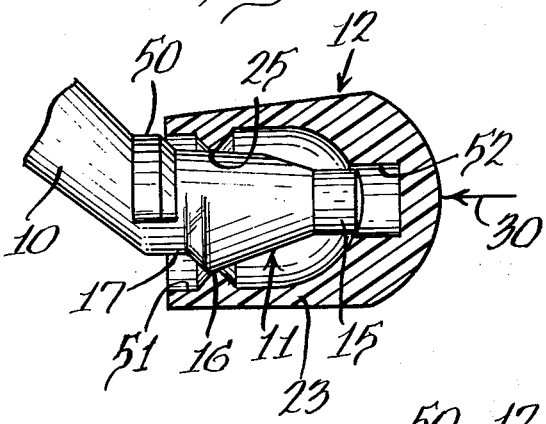
Fig. 3.
50
25
12
52
30
10
17
51
16
11
15
23
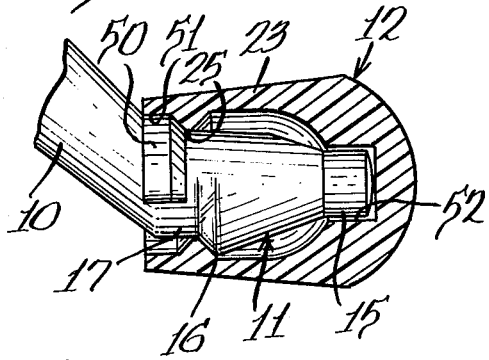
Fig. 4.
50
51
25
23
12
10
52
17
16
11
15
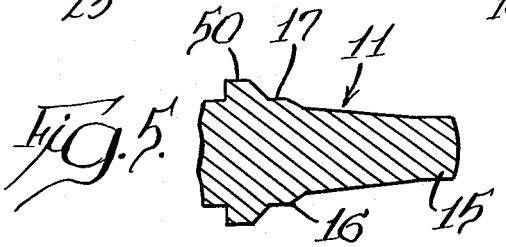
Fig. 5.
50
17
11
16
15

ROTATABLE KNOB ASSEMBLY

BACKGROUND OF THE INVENTION

This invention pertains to a rotatable knob assembly and, more particularly, to a snap-on knob which may be mounted to an operating member such as a handle without permanent deformation of the knob whereby the knob may be permanently held on the handle and be rotatable relative thereto.

Rotatable knob structures are well known. Many different types are found in use in structures wherein an operating member such as a handle is to be rotated to cause movement such as in window operating hardware. A search of the prior art has revealed U.S. Pat. Nos. 2,978,927, 3,306,643 and 3,406,590, wherein a knob or cover can be mounted to associated structure by means of either a snap-on or a snap-in operation. In each instance, the knob or cover has segmented structural elements which, because of their segmented nature, may change shape or flex to move past a locking abutment and then return to initial position to retain the knob or cover in place. Permanent retention of the knob depends upon the ability of the segments to retain their locked position during the life of the knob. In the event replacement of the knob is desired, such replacement would be extremely difficult.

SUMMARY OF THE INVENTION

The rotatable knob assembly disclosed herein has only two parts, namely, a knob and an operating member with a mounting section, with both parts being constructed to avoid the need for elaborate or difficult tooling and manufacturing processes and with the knob being easily mounted on the handle and rotatably retained thereon.

A primary feature of the invention is to provide a knob, preferably formed of a plastic material such as thermoplastic, which may be assembled to the handle without any circumferential tensile stresses on the knob, but with merely a distortion of the knob to move past a generally elliptical shape on a mounting section of the handle, and, after moving therepast, the knob returns to its original shape. The knob has a generally cylindrical cavity and with a locking ring formed within the knob cavity engaging behind the elliptical shape of the mounting section to retain the knob in position. Facilitating rotation of the knob and a long operating life therefor are a plurality of bearing areas on the mounting section with coact with the interior portions of the knob for rotatably guiding the knob and preventing any undesired radial contact of the knob's internal locking ring which could lead to wear and abrasion thereof and possible inadvertent release of the knob.

Another object of the invention is to provide a handle and knob combination with the knob being rotatable on the handle, wherein the handle has a mounting section for the knob with a free end, a first part tapering from said free end to the generally elliptical cross section shape, a second part wherein the cross section shape becomes cylindrical, with both parts having the same perimetrical length and said knob being formed of a plastic material and having an open-ended cavity defined by a surrounding wall and with the shape and material of the knob permitting distortion of the shape of the wall without stretching thereof. A raised ridge extends around the inner surface of the surrounding wall to form an inwardly protruding locking ring lying in a plane normal to the depth of the cavity and has a circular configuration with the perimetrical length of the locking ring being substantially the same as the perimetrical length of the parts of the mounting section whereby placement of the knob on the mounting section causes the locking ring to distort to elliptical shape without stretching of the surrounding wall, and after positioning on the second part of the mounting section, the locking ring returns to the normal circular configuration to be locked behind said elliptically shaped part.

BRIEF DESCRIPTION OF THE DRAWING

FIG. 1 is a side elevational view of the components of the invention shown disassembled and with the knob in cross section;

FIG. 2 is an end elevational view of the operating member or handle, taken looking along the line 2—2 in FIG. 1;

FIG. 3 is a fragmentary view similar to FIG. 1, showing the knob partially assembled with the operating member;

FIG. 4 is a view showing the components in assembled relation; and

FIG. 5 is a section taken generally along the line 5—5 in FIG. 1.

DESCRIPTION OF THE PREFFERED EMBODIMENT

The rotatable knob assembly is shown in FIG. 1 and includes a rotatable operating member 10 in the form of a handle, having a mounting section, indicated generally at 11, and a snap-on knob, indicated generally at 12. The mounting section 11 has a generally cylindrical free end 15 which tapers to a first part 16 having a noncircular transverse cross section which is preferably generally elliptical, as seen particularly in FIG. 2. The mounting section has a second part 17 adjacent the elliptically shaped part 16, which is of a cylindrical shape to have a generally circular cross section and with the perimetrical length of the surface of part 16 and cylindrical part 17 being substantially the same.

The knob 12 is formed of a plastic material, preferably a thermoplastic such as nylon type 6 or acetal, and has a body 20 with an open-ended, generally cylindrical cavity 22 and a surrounding wall 23 which is flexible.

A locking ring 25 is defined by ridge means having a small protruding continuous ridge upstanding from the inner surface of the surrounding wall, with the edge of the ridge having a circular configuration with a perimetrical length substantially equal to the perimetrical length of the parts 16 and 17 of the mounting section 11.

In assembly of the components, the knob 12 is placed on the mounting section 11 by movement in the direction indicated by an arrow 30 in FIG. 3, with the locking ring 25 first contacting the elliptically shaped part 16 of the mounting section. At this point there is a distortion of the surrounding wall 23 of the knob to have the locking ring assume the shape of the part 16. However, this is without any circumferential tensile stresses since the perimetrical length of the interengaging parts is the same. Further movement of the knob 12 to the left as viewed in FIGS. 3 and 4 brings the knob 12 to final position relative to the handle 10, and with the locking ring 25 being located at the cylindrical part 17 of the mounting section whereby the knob's surrounding wall 23 and the locking ring 25 may return to their circular configuration, and with the locking ring having a part thereof engaged for positioning behind the elliptical part 16. This final position is shown in FIG. 4.

Additionally, several bearing areas are provided on the mounting section 11 for coaction wth interior parts of the knob 12. A first bearing area is provided by a generally semicircular surface 50 formed at the junction between the mounting section and the remaining part of the handle 10. As shown particularly in FIG. 4, this bearing area coacts with a portion of the interior surface of the knob's surrounding wall 23 and which is identified as 51.

A second bearing area is provided by the cylindrical free end 15 of the mounting section 11 which is positioned within a cylindrical recess 52 located at the base of the cavity 22. A third bearing area is provided by a lower surface of the elliptical part 16 of the mounting section, which may engage a part of the inner surface of the surrounding wall 23 immediately adjacent the locking ring 25. This last bearing area is at a side of the mounting section 11 opposite the semi-cylindrical surface 50 forming the first described bearing area. The three bearing areas formed on the mounting section prevent any undesired radial contact of the locking ridge 25 to prevent abrasion of the ridge during rotation of the knob relative to the handle and which might lead to increase in the perimetrical length of the locking ridge to the extent whereby the locking ring might be free to move outwardly past the elliptical part 16.

It is believed that the assembly and operation of the structure is readily apparent from the foregoing description. However, to briefly summarize, it will be noted that the parts are initially positioned as shown in FIG. 1 and then the knob 12 is moved in the direction of the arrow 30 in FIG. 3 to place the free end 15 of the mounting section within the recess 52 of the knob and to distort the knob to a generally elliptical configuration for passage of the locking ring 25 past the elliptical part 16 of the mounting section to a final operative position shown in FIG. 4. In the event it is desired to remove the knob, the knob may be firmly grasped to distort it to an elliptical configuration and then the knob forcefully pulled off the mounting section 11. It will be evident that the force required for either placement or removal of the knob, and particularly for removal, may be controlled by the choice of appropriate materials for the knob and the thickness of the surrounding wall 23 of the knob.

As noted previously, the first part 16 of the mounting section may have a transverse sectional shape other than elliptical, provided that it has the required perimetrical length and forms a surface for locking engagement with the locking ring 25 when the knob is finally positioned.

With the structure disclosed herein, there are only two parts involved and with the knob being readily formed by plastic forming processes. The handle, and particularly the mounting section thereof, can be manufactured by simple injection cast techniques without requiring any sliding cores in the tooling.

I claim:

1. The combination of an operating member and freely rotating knob carried thereon, wherein said operating member has a mounting section for the knob including a first part intermediate the length of said mounting section having a generally elliptical cross section and another adjacent part having a generally circular cross section, both of said parts having substantially the same perimetrical length, and said knob being of flexible material and having a body with an open-ended cylindrical cavity and a surrounding wall, and ridge means within said cavity raised from said wall to define a locking perimeter of approximately the same perimetrical length as the perimetrical lengths of said parts whereby placement of the knob on said mounting section in operative position by insertion of the mounting section into said cavity distorts the knob to have the ridge means assume an elliptical configuration in moving past said first part of the mounting section and said ridge means thereafter being located at said adjacent part of the mounting section and returning to a normal contour to lock behind said first part of the mounting section.

2. A combination as defined in claim 1 wherein said ridge means is located within the knob cavity at a short distance from the open end thereof and a first bearing area on said mounting section engageable by said surrounding wall at the open end of the cavity.

3. A combination as defined in claim 2 wherein a free end of said mounting section is cylindrical to define a bearing area, and a cylindrical recess at a base of said knob cavity to receive said free end of the mounting section for additional bearing support of the knob.

4. A combination as defined in claim 3 wherein a third bearing area for the knob is defined by a surface of said mounting section first part which is at a side of the mounting section opposite said first bearing area.

5. A combination as defined in claim 4 wherein said first part of the intermediate section and said first bearing area are spaced apart lengthwise of the mounting section and said ridge means is positioned therebetween when the knob is in operative position.

6. A rotatable knob assembly including a handle and a knob with the knob being rotatable on the handle: said handle having a mounting section for the knob with a free end, a first part tapering from said free end to a generally elliptical cross section shape, and a second cylindrical part, both of said parts having the same perimetrical length; said knob being formed of a plastic material and having an open-ended cavity defined by a surrounding wall, the shape and material of the knob permitting distortion of the shape of said wall without stretching thereof, and a raised ridge extending around the inner surface of said surrounding wall to form an inwardly protruding locking ring lying in a plane normal to the depth of the cavity and having a circular configuration, with the perimetrical length of said locking ring being substantially the same as the perimetrical length of said parts whereby insertion of the mounting section relative to the knob cavity causes said locking ring to distort to said elliptical shape and after positioning on said second part the locking ring elastically returns to the normal circular configuration to be locked behind said elliptically shaped part.

7. A handle and knob combination as defined in claim 6 wherein the mounting section has three bearing areas for the knob including said free end which is cylindrical, a first surface at the end of the mounting section opposite said free end and a second surface intermediate said ends and which is at a side of the mounting section opposite said first surface, and said knob has parts thereof for engaging said bearing areas including a cylindrical recess at the base of said cavity to receive said free end of the mounting section.

8. The combination of an operating member and freely rotating knob carried thereon, wherein said operating member has a mounting section for the knob including a first part intermediate the length of said mounting section having a noncircular transverse cross section and another adjacent part having a generally circular transverse cross section, both of said parts having substantially the same perimetrical length, and said knob being of flexible material and having a body with an open-ended cylindrical cavity and a surrounding wall, and ridge means within said cavity raised from said wall to define a locking perimeter of approximately the same perimetrical length as the perimetrical lengths of said parts whereby placement of the knob on said mounting section in operative position by insertion of the mounting section into said cavity distorts the knob to have the ridge means assume said noncircular configuration in moving past said first part of the mounting section and said ridge means thereafter being located at said adjacent part of the mounting section and returning to a normal contour to lock behind said first part of the mounting section.

* * * * *